US005762273A

United States Patent [19]

Shubin

[11] Patent Number: 5,762,273

[45] Date of Patent: Jun. 9, 1998

[54] MULCHER APPARATUS

[76] Inventor: Don Shubin, P.O. Box 18556, Irvine, Calif. 92713

[21] Appl. No.: 752,481

[22] Filed: Nov. 19, 1996

[51] Int. Cl.[6] ..... B02C 18/12

[52] U.S. Cl. ..... 241/60; 241/152.2; 241/261

[58] Field of Search ..... 241/92, 152.2, 241/277, 261, 55, 56, 60

[56] References Cited

U.S. PATENT DOCUMENTS

| | | | |
|---|---|---|---|
| 3,054,565 | 9/1962 | Willems | 241/261 |

FOREIGN PATENT DOCUMENTS

| | | | |
|---|---|---|---|
| 1053781 | 11/1983 | U.S.S.R. | 241/261 |
| 1563756 | 5/1990 | U.S.S.R. | 241/261 |
| 1630664 | 2/1991 | U.S.S.R. | 241/261 |
| 1653626 | 6/1991 | U.S.S.R. | 241/261 |

OTHER PUBLICATIONS

Bark Shredder, Sep. 1979.

*Primary Examiner*—Mark Rosenbaum
*Attorney, Agent, or Firm*—Gary Appel

[57] ABSTRACT

A mulching apparatus is described for converting green waste, including tree branches, small limbs, leaves, and grass clippings into a pulverized mulch. The apparatus comprises a green waste agitator hopper in the shape of an inverted, truncated cone, the hopper having a plurality of first blades fixed to an inner wall and projecting toward a vertical axis of the hopper. A waste agitator arm is rotatably mounted in the hopper through a bottom of the hopper for rotational movement about the vertical axis. The waste agitator arm has a plurality of second blades fixed thereto so as to intermesh with the hopper blades when the arm is rotated. A conduit is connected to a side region of the hopper to enable feeding waste material from the hopper to a fan mulching pulverizer disc rotatably installed in the conduit. The fan mulching pulverizer disc reduces the hopper waste material to a pulverized mulch and then blows the pulverized mulch out of the apparatus through a discharge duct.

11 Claims, 3 Drawing Sheets

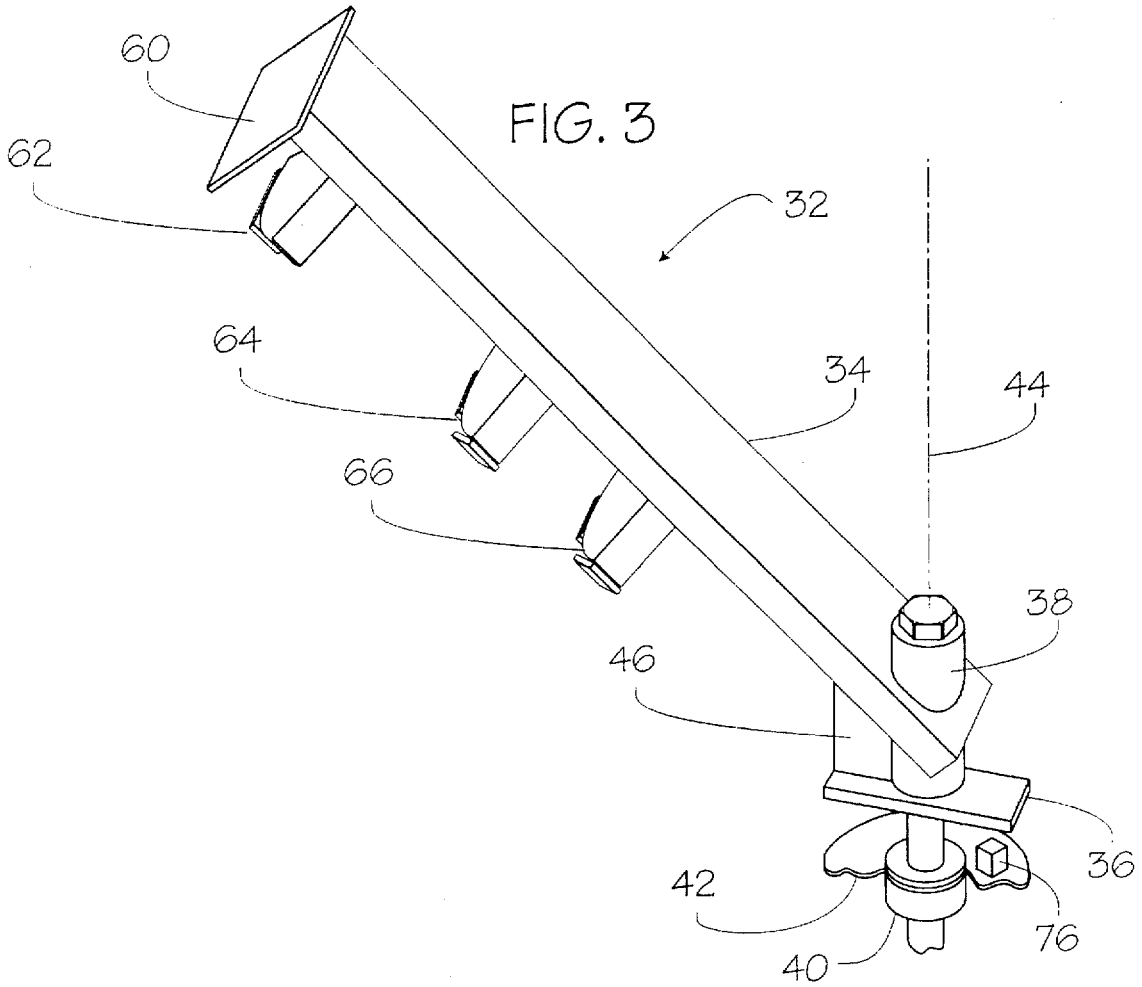
FIG. 3
FIG. 4
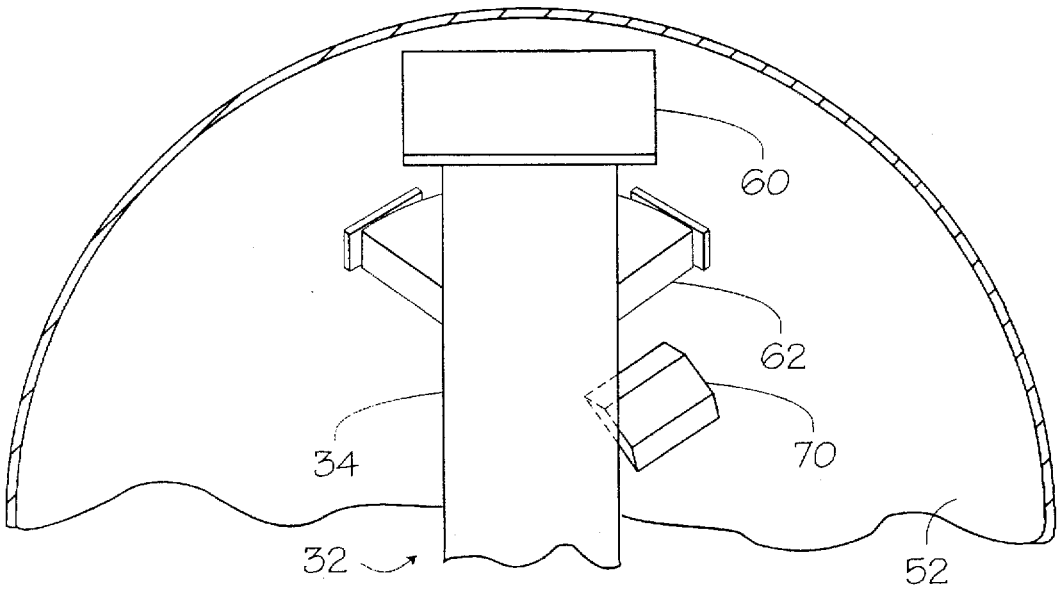

MULCHER APPARATUS

BACKGROUND OF THE INVENTION

1. Field of the Invention

The present invention relates generally to the field of apparatus for reducing tree trimmings leaves, grass and branches and the like to mulch and, more particularly, to mulching apparatus configured for such purpose.

2. Background Discussion

In my co-pending U.S. patent application, Ser. No. 08/497,871, filed on Jul. 3, 1995, now abandoned, I disclose a vehicle-mounted apparatus for picking up and mulching so-called "green waste," that is, cut grass, weeds, leaves, brush, hedge and shrub trimmings and small tree branches. The disclosed apparatus includes a rotably-driven mulching disc mounted in lower regions of a hopper into which green waste is introduced either by a vacuum pick-up or by a hydraulically-actuated arm having jaws which can be operated to close over a pile of tree branches and then drop them into the hopper.

The mulcher disc has blades which shred the green waste into small particles which are then blown by the mulcher blades-which function as a fan-into a bin on the vehicle, later to be used, for example, to mulch highway plants, shrubs and trees.

Although the vacuum suction hose works well for small green waste, it becomes a significant disadvantage and uneconomical when picking up large volumes in single collection locations.

It is, therefore, a principle objective of the present invention to provide a larger capacity mulcher which economically performs the function of mulching branches, leaves and clippings in large volumes from various collection locations.

SUMMARY OF THE INVENTION

In accordance with the present invention, there is provided a high volume, rapid mulching apparatus for mulching large amounts of green waste that includes tree branches, as well as smaller materials such as brush, leaves, and grass clippings.

The mulching apparatus comprises a green waste receiving unit in the shape of a flared entry guide, an accumulator drum, an inverted and truncated cone shaped hopper, and having a plurality of first blades fixed to an inner wall and projecting toward a vertical axis of the hopper.

Included is an inclined waste agitator arm that is mounted in the hopper through a bottom area of the hopper for rotational movement about the vertical axis. The waste agitator arm has a plurality of second blades fixed to it so as to intermesh with the plurality of hopper blades and to push waste material toward the mulching blades when the arm is rotated about the vertical axis of the hopper. First drive means are included for rotatably driving the waste agitator arm.

A conduit is connected to a side region of the hopper and fan mulching means are installed in the conduit for pulverizing mulch into the green waste received from the hopper and for discharging mulched green waste from the conduit.

Preferably, a cover plate is provided for covering a portion of an upper end of the hopper for preventing green waste, being pulverized by the high velocity mulching fan, from being thrown back out of the upper end of the hopper, and for assisting in sound reduction and to assist in keeping the green waste in the hopper during the mulching operation.

It is preferred that the waste agitator arm be substantially parallel with a side wall of said hopper and spaced inwardly therefrom toward said vertical axis and that the length of said waste agitator arm is slightly shorter than the length of the hopper side wall. It is also preferred that the mulching means include a pulverizer disc having a plurality of mulching pulverizer fan blades and including second drive means for rotatably driving the mulch pulverizer disc.

BRIEF DESCRIPTION OF THE DRAWINGS

The present invention can be more readily understood by a consideration of the following detailed description when taken in conjunction with the accompanying drawings, in which:

FIG. 3 is a perspective drawing of the waste agitator arm assembly, showing details of it construction; and FIG. 4 is a transverse cross-sectional drawing taken along line 4—4 of FIG. 1 showing additional features of the waste agitator arm assembly.

In the various FIGS., the same elements and features are given the same reference numbers.

DESCRIPTION OF THE PREFERRED EMBODIMENT

Figure 1:
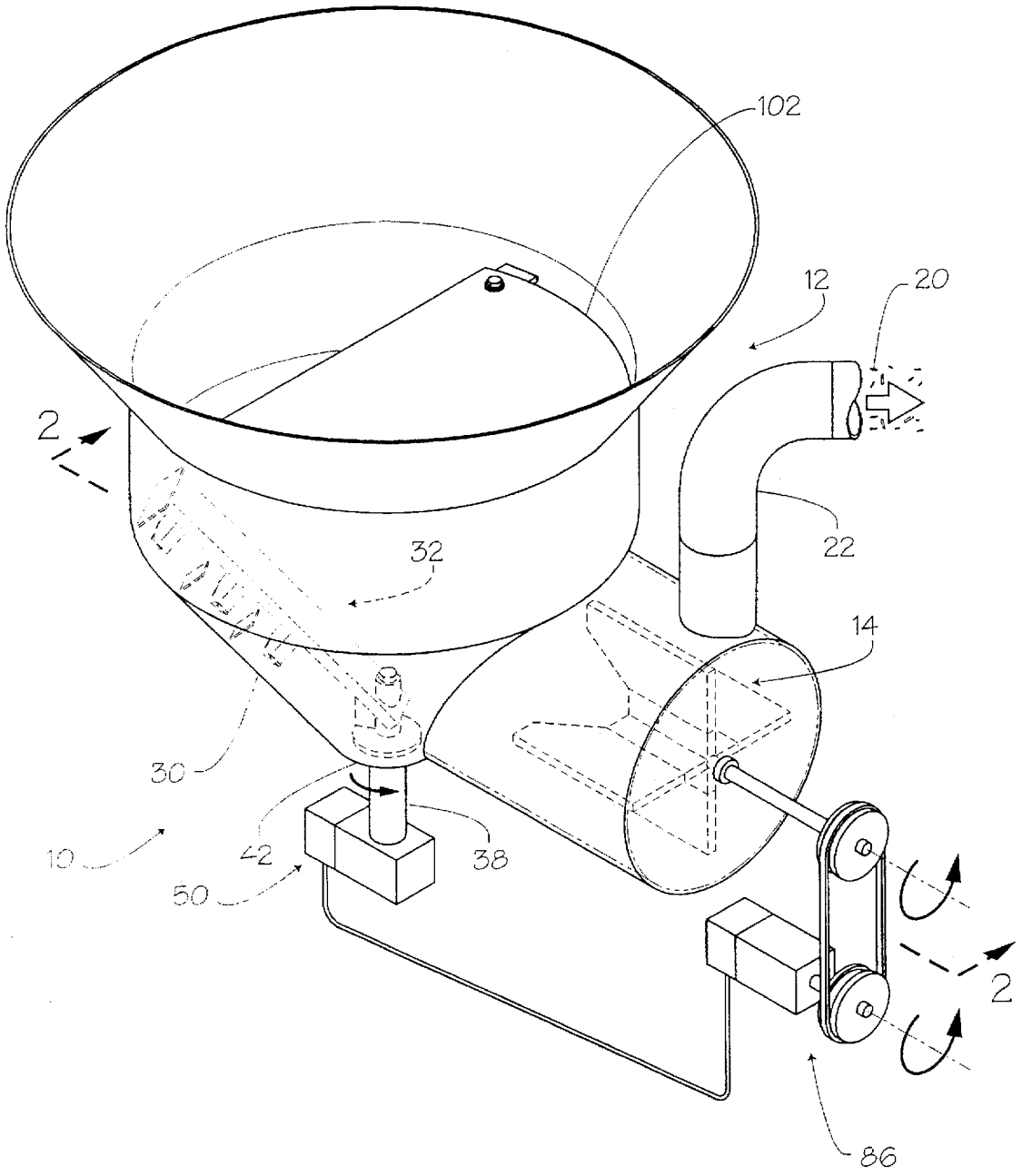
FIG. 1 is a partially cut-away perspective drawing of the mulching apparatus, showing a flared entry guide, an accumulator drum, and a cone shaped hopper into which green waste is dumped and having a rotably-driven waste agitator arm having blades which intermesh with blades mounted on the hopper wall and showing a fan mulching pulverizer disc mounted in a conduit connected to a side region of the hopper for receiving waste material therefrom, and a second optional waste agitator arm being shown in phantom lines.
Figure 2:
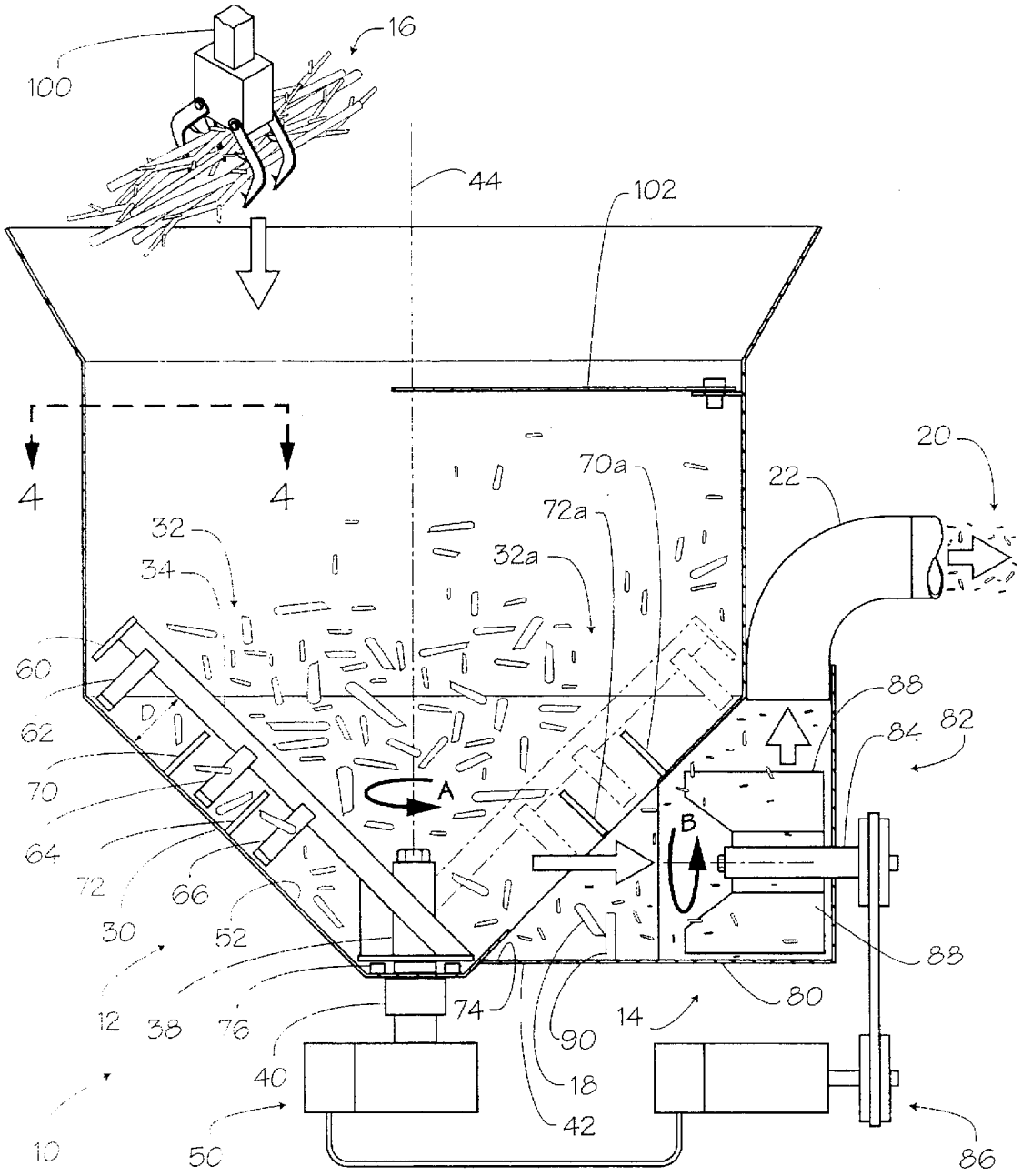
FIG. 2 is an longitudinal cross-sectional drawing taken along line 2—2 of FIG. 1 showing the manner in which blades on the waste agitator arm assembly intermesh with blades projecting from the hopper and showing the fan mulching pulverizer disc portion of the apparatus.

There is shown in FIGS. 1 and 2, in accordance with a preferred embodiment of the present invention, a mulching apparatus 10 adapted for converting large amounts of "green waste", such as trimmings from trees, shrubs and brush, into mulch which can be used to conserve water by mulching plants and the like.

Comprising generally mulching apparatus 10, as more particularly described below, are waste agitator portion 12 and a mulching disc portion 14. Waste agitator portion 12 operates to cut received tree branches and brush 16 (FIG. 2) into relatively small particles, agitate them, and direct them toward mulching pulverizer portion 18. Mulch pulverizer portion 14 operates to receive particles 18 from waste agitator portion 12 and to reduce them to finer particulates of mulch 20, which is discharged from apparatus 10, through a discharge duct or chute 22, for example, to a mulch-receiving bin (not shown) or, alternatively, to a site having mulch applied by apparatus 10.

As further shown in FIG. 2, waste agitator portion 12 comprises a funnel-shaped hopper 30 which has the form of an inverted, truncated right circular cone. Rotatably installed in hopper 30 is a strong, elongate, rigid waste agitator arm assembly 32.

Although one such waste agitator arm assembly 32 is all that is ordinarily used and required for waste agitator portion 12, a second waste agitator arm assembly 32*a*, shown in phantom lines, may be provided at 180 degrees from waste agitator arm assembly 32 if needed for efficiency, or balancing, or if specified by a customer.

Waste agitator arm assembly 32 comprises a steel waste agitator arm 34, a lower (proximal) end of which is welded to a rigid base plate 36 through which is fixed a drive shaft 38.

Drive shaft 38 is journaled for rotation through a bearing box 40 installed at a bottom 42 of hopper 30, and is aligned along a vertical axis 44 of waste agitator portion 12 and hopper 30 (FIGS. 2 and 3). A strong, generally triangular, gusset plate 46 is welded between waste agitator arm 34, plate 36, and drive shaft 38 to provide strong, rigid mounting of the waste agitator arm to the drive shaft and to further help direct the material to the fan mulching pulverizer blades.

First drive means 50, comprising, for example, an electric or hydraulic motor or an internal combustion engine, are connected to drive shaft 38 for rotatably driving waste agitator arm assembly 32 in the direction of Arrow "A"in FIG. 2.

As can be seen in FIG. 2, waste agitator arm assembly 32 is constructed and mounted in hopper 30 so that waste agitator arm 34 is generally parallel to an inner surface 52 of the hopper, and is spaced a distance, D, therefrom. The distance, D, may, for example, be about ten to twelve inches.

As shown in FIGS. 2 and 3, waste agitator arm 34 has welded at right angles thereto a number of first blades or knives, four blades, 60, 62, 64 and 66 being shown. Such blades 60, 62, 64 and 66 are constructed of hardened steel and are spaced apart along waste agitator arm 34, with blade 60 being at the free (distal) end of the arm. Blades 60, 62, 64 and 66, upon installation of waste agitator arm assembly 32 in hopper 30, are directed toward hopper inner surface 52 and may terminate two or three inches therefrom.

Fixed, as by welding, to hopper inner surface 52, intermediate waste agitator arm blades 62, 64 and 66 are second knifes or blades 70 and 72 which project inwardly from hopper 30 toward waste agitator arm 34 and vertical axis 44. Hopper blades 70 and 72, which are preferably similar in construction to waste agitator arm blades 60, 62, 64 and 66, terminate two or three inches from waste agitator arm 34 (when the waste agitator arm is aligned with the hopper blades, as shown in FIG. 2) and overlap waste agitator arm blades 62, 64 and 66 by several inches (see also FIG. 4).

It will be appreciated that although four waste agitator arm blades 60, 62, 64 and 66 and two hopper blades 70 and 72 are disclosed, a greater number of blades of each type may be provided and, as shown in FIG. 2, additional sets of hopper blades **70*a* and 72*a* may be provided in different regions of hopper 30 such that as waste agitator arm assembly 32 is rotatably driven by drive means 50 around the inside of hopper 30, more than one set of hopper blades are encountered by waste agitator arm blades 60, 62, 64 and 60 so as to increase the cutting efficiency of waste agitator portion 12**.

Surrounding bearing box 40, and welded to an inner surface 74 of hopper bottom 42 is an annular steel blade 76 which extends upwardly toward waste agitator arm assembly base plate 36. Blade 76 functions as another hopper blade, with base plate 36 functioning as another waste agitator arm blade.

A steel duct or conduit 80 is welded to hopper 30 in a sidewall region of the hopper (FIG. 2). Installed in duct 80, which comprises part of mulching portion 14, is a fan mulching pulverizer disc 82 which is fixed to a drive shaft 84. Second drive means are connected to drive shaft 84 to cause rotation of fan mulching pulverizer disc 82 in the direction of arrow "B"within duct 80. Fan mulching pulverizer disc 82 is formed having a plurality of blades 88 and is preferably constructed in the manner disclosed in my co-pending application Ser. No. 08/497,871, which is incorporated herein in its entirety by specific reference.

Fan mulching pulverizer disc 82 functions also as a blower or impeller such that particular material 18 fed into mulching portion 14 from agitator portion 12 is mulched to further reduce it in size to mulched particulate, and then it is blown or impelled from duct 80 out through discharge duct 22 (FIG. 2).

A short, steel baffle plate 90 is welded to hopper bottom 42 adjacent to the entrance to duct 80 to prevent large particulate material 18 from entering and possibly blocking the duct 80.

Operation of Apparatus 10:

The operation of the mulching apparatus is considered to be apparent from the above description when taken in conjunction with FIGS. 1–4. Nevertheless, a brief description of the operation is set forth hereinbelow.

Green waste, such as tree branches 26 and small limbs, is picked up from the ground by a grapple or claw 100 in the manner described in my co-pending application Ser. No. 08/497,871, and is delivered through the flared entry guide and into the accumulator drum, and then is drawn into hopper 30. Preferably, as shown in FIGS. 1 and 2, part of the open top of hopper 20 is covered by a plate 102 so as to partially enclose and prevent branches and the like from being thrown back out of hopper 30 during the fan mulch pulverizer operation by mulching pulverizer portion 14.

The branches and the like dumped into waste agitator portion 12 by grapple 100 are driven spirally around and downward inside of the hopper by the rotation of waste agitator arm assembly 32 and the suction of mulching pulverizer portion 14. As the branches and the like are driven around and pushed downwardly inside hopper 30, they are gradually caught between waste agitator arm blades 60, 62, 64 and 66 and hopper blades 70 and 72 and are torn, cut, and ripped into successively smaller pieces. The waste agitator arm provides the additional function of preventing the bridging of tree limbs in the hopper.

After being revolved, agitated, and drawn downward in the hopper, the branches and the like dropped into hopper 30 are reduced in size and are pushed to the bottom of the hopper where they are expelled by action of the rotating waste agitator arm assembly 32, through duct 80 and into engagement with fan mulching pulverizer disc 82. Waste 18 is further reduced in size to pulverized mulch by rotating fan pulverizer disc 82 and are impelled or blown by the fan pulverizer disc into and out through discharge duct 22.

Although there has been described and illustrated a mulching apparatus in accordance with the present invention for purposes of illustrating the manner in which the invention may be used to advantage, it is to be appreciated that the invention is not limited thereto. Therefore, any and all variations and modifications that may occur to those skilled in the applicable art are to be considered as being within the scope and spirit of the claims as appended hereto.

What is claimed is:

1. A mulching apparatus for providing a pulverized mulch from green waste, including tree branches, small limbs, leaves and clippings, said apparatus comprising:

a. a green waste receiving hopper, said hopper being in the shape of an inverted, truncated cone;

b. a plurality of first blades fixed to an inner wall of said hopper and projecting toward a vertical axis of the hopper;

c. at least one inclined waste agitator arm mounted in said hopper through a wall of the hopper for rotational movement about said vertical axis and having a plurality of second blades fixed to said arm so to intermesh with said plurality of first blades when the arm is rotated about said vertical axis;

d. means connected for rotatably driving said arm;

e. a conduit connected to a sidewall region of said hopper; and f. mulching pulverizer means installed in said conduit for mulching green waste drawn from the hopper and for discharging mulched green waste from the conduit.

2. The mulching apparatus as claimed in claim 1, including a cover for covering a portion of an upper end of the hopper for preventing green waste being pulverized by the mulching pulverizer means from being thrown back out of the upper end of the hopper.

3. The mulching apparatus as claimed in claim 1, wherein said waste agitator arm is substantially parallel with a side wall of said hopper and spaced inwardly therefrom toward said vertical axis.

4. The mulching apparatus as claimed in claim 3, wherein the length of said waste agitator arm is shorter than the length of said hopper side wall.

5. The mulching apparatus as claimed in claim 1, wherein said mulching means includes a fan mulching disc having a plurality of fan mulching pulverizer blades and including second drive means for rotatably driving said fan mulching disc.

6. A mulching apparatus for providing a mulch from green waste, including tree branches, small limbs, leaves and grass clippings, said apparatus comprising:

a. a green waste receiving hopper, said hopper being in the shape of an inverted, truncated cone, b. a plurality of first blades fixed to an inner wall of said hopper and projecting toward a vertical axis of the hopper;

c. at least one inclined waste agitator arm mounted in said hopper through a bottom of the hopper for rotational movement about said vertical axis and having a plurality of second blades fixed to said arm so to intermesh with said plurality of first blades when the arm is rotated about said vertical axis, said waste agitator arm being substantially parallel with a side wall of said hopper and spaced inwardly therefrom toward said vertical axis, d. means connected for rotatably driving said waste agitator arm;

e. a conduit connected to a side region of said hopper; and f. a fan mulching pulverizer disc installed in said conduit for mulching green waste received from the hopper and for discharging mulched pulverized green waste from the conduit; and g. second drive means for rotating said mulching pulverizer disc in said conduit.

7. The mulching apparatus as claimed in claim 6, including a cover for covering a portion of an upper end of the hopper for preventing green waste being pulverized by rotating fan mulching pulverizer disc from being thrown back out of the upper end of the hopper.

8. The mulching apparatus as claimed in claim 6, wherein the length of said waste agitator arm is shorter than the length of said hopper side wall and is spaced between about one foot inwardly therefrom toward said vertical axis.

9. A mulching apparatus for providing a mulch from green waste, including tree branches and small limbs, said apparatus comprising:

a. a green waste agitator hopper, said hopper being in the shape of an inverted, truncated cone, b. a plurality of first blades fixed to an inner wall of said hopper and projecting toward a vertical axis of the hopper;

c. at least one inclined waste agitator arm mounted in said hopper through a bottom of the hopper for rotational movement about said vertical axis and having a plurality of second blades fixed to said arm so to intermesh with said plurality of first blades when the arm is rotated about said vertical axis, said waste agitator arm being substantially parallel with a side wall of said hopper and spaced inwardly therefrom toward said vertical axis by about 10 to 12 inches;

d. means connected for rotatably driving said waste agitator arm;

e. a conduit connected to lower regions of said hopper; and f. a fan mulching pulverizer disc installed in said conduit for pulverizing green waste received from the hopper and for discharging pulverized mulched green waste from the conduit; and g. second drive means for rotating said fan mulching pulverizing disc in said conduit.

10. The mulching apparatus as claimed in claim 9, including a cover for covering a portion of an upper end of the hopper for preventing green waste being pulverized by the rotating fan mulching pulverizer disc from being thrown back out of the upper end of the hopper.

11. The mulching apparatus as claimed in claim 9, wherein the length of said waste agitator arm is shorter than the length of said hopper side wall.

* * * * *